US005095341A

United States Patent [19]

Yoshida et al.

[11] Patent Number: 5,095,341

[45] Date of Patent: Mar. 10, 1992

[54] IMAGE FORMING APPARATUS USING ONE COMPONENT DEVELOPING AGENT WITH ROLLER APPLICATOR

[75] Inventors: Minoru Yoshida, Tokyo; Kouji Hirano, Yokosuka, both of Japan

[73] Assignee: Kabushiki Kaisha Toshiba, Kawasaki, Japan

[21] Appl. No.: 667,285

[22] Filed: Mar. 11, 1991

[30] Foreign Application Priority Data

Mar. 13, 1990 [JP] Japan ..... 2-61948

[51] Int. Cl.[5] ..... G03G 15/08

[52] U.S. Cl. ..... 355/259; 118/653

[58] Field of Search ..... 355/259; 118/653; 430/120

[56] References Cited

U.S. PATENT DOCUMENTS

| | | | |
|---|---|---|---|
| 2,895,847 | 7/1959 | Mayo | 118/653 Y |
| 4,833,059 | 5/1989 | Tomura et al. | 430/120 |
| 4,899,689 | 2/1990 | Takeda et al. | 355/259 X |
| 4,967,231 | 10/1990 | Hosoya et al. | 355/259 Y |

FOREIGN PATENT DOCUMENTS 1-178986 7/1989 Japan .

OTHER PUBLICATIONS

Japan Hard Copy 89 EP-7; Contact-Type Development System Using Mono-component nonmagnetic Toner; M. Hosoya et al., Toshiba R&D Center, Toshiba Corporation, and M. Endo et al., R&D Laboratory, Tokyo Electric Co., Ltd.

*Primary Examiner*—Joan H. Pendegrass
*Attorney, Agent, or Firm*—Foley & Lardner

[57] ABSTRACT

An image forming apparatus including a developing roller, opposing a rotatable photoreceptor, for supplying an one-component developing agent to the photoreceptor, and a blade for forming a developing agent layer of the one-component developing agent to be supplied to the photoreceptor on the developing roller. The developing of the image is performed under conditions satisfying the following relation:

$$0.4 \leqq m_{dev}/(m_1 \cdot p) \leqq 0.9$$

where $m_1$ is an amount of the one-component per unit area of the developing agent layer, $m_{dev}$ is the amount of the one-component developing agent deposited per unit area on the photoreceptor, at the maximum image density, and p is the ratio of the developing roller to that of the rotatable photoreceptor.

7 Claims, 13 Drawing Sheets

IMAGE FORMING APPARATUS USING ONE COMPONENT DEVELOPING AGENT WITH ROLLER APPLICATOR

BACKGROUND OF THE INVENTION

1. Field of the Invention

The present invention relates to an image forming apparatus applied to electrophotography and electrostatic recording.

2. Description of the Related Art

As a developing method of visualizing an electrostatic latent image, electrophotography is most widely used. Of the electrophotographic known schemes, a two-component developing method using a two-component developing agent is generally employed. This developing agent is a mixture of a fine coloring powder called a toner, and a magnetic powder, called a carrier. In this method, toner particles are charged to be electrostatically attracted to a latent image.

In the two-component developing method, however, a developing unit tends to be increased in size. For this reason, in recent small copying machines and printers, one-component developing methods, which require no carrier, have been increasingly employed.

Of these one-component developing methods, a method of using a nonmagnetic toner facilitates a reduction in size, weight, and cost of a developing unit because it requires no expensive magnetic rollers. An advantage of another one-component developing method using an elastic roller as a developing roller is that even if the developing roller is brought into contact with an electrostatic latent image carrying member (a photo-conductive member in electrophotography), the electrostatic latent image carrying member is not damaged. Since the developing roller is brought into contact with the electrostatic latent image carrying member in this method, a developing electrode can be positioned near an electrostatic latent image. This improves the sharpness of character and line images, and hence allows development with high image quality.

In such a one-component developing method using a nonmagnetic toner, however, since a developing roller has no magnetic pole, nonmagnetic toner particles must be transferred by an electrostatic force and a physical force between the developing roller and the nonmagnetic toner. For this reason, if images are continuously formed, the following problems are posed: a decrease in black solid image density, the defective formation of a toner layer, an increase in background fog, and the like.

SUMMARY OF THE INVENTION

It is an object of the present invention to provide an image forming apparatus which allows the maintenance of a proper image density even if solid images are continuously developed.

According to the present invention, there is provided an image forming apparatus comprising roller means, opposing a rotatable image carrying member, for supplying a one-component developing agent to the rotatable image carrying member, means for forming a developing agent layer of the one-component developing agent to be supplied to the image carrying member on the roller means, and means for developing a latent image on the rotatable image carrying member by the one-component developing agent supplied by the supplying means under conditions satisfying the following relation:

$$0.4 \leqq m_{dev}/(m_1 \cdot p) \leqq 0.9$$

where $m_1$ is an amount of the one-component developing agent per unit area of the developing agent layer, $m_{dev}$ is an amount of the one-component developing agent deposited per unit area on the image carrying member, at the maximum image density, and p is a ratio of a circumferential speed of said roller means to that of the rotatable image carrying member. The developing step is preferably performed under conditions satisfying the following relation:

$$0.4 \leqq m_{dev}/(m_1 \cdot p) \leqq 0.8$$

In addition, according to the present invention, there is provided an image forming apparatus comprising roller means, opposing a rotatable image carrying member, for supplying an one-component developing agent to the rotatable image carrying member, means for forming a developing agent layer of the one-component developing agent to be supplied to the image carrying member on the roller means, and means for developing a latent image on the rotatable image carrying member by the one-component developing agent supplied by the supplying means, wherein an amount of the developing agent deposited per unit area on the roller means is 0.3 to 0.8 mg/cm$^2$.

Furthermore, according to the present invention, there is provided an image forming apparatus comprising roller means, opposing a rotatable image carrying member, for supplying an one-component developing agent to the rotatable image carrying member, means for forming a developing agent layer of the one-component developing agent to be supplied to the image carrying member on the roller means, and means for developing a latent image on the rotatable image carrying member by the one-component developing agent supplied by the supplying means, wherein a ratio of a circumferential speed of the roller means to that of the image carrying member is 1.2 to 3.0.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The present invention is characterized in that a developing process in a nonmagnetic one-component developing method is performed under conditions satisfying the following relation:

$$0.4 \leqq m_{dev}/(m_1 \cdot p) \leqq 0.9$$

where $m_1$ is the developing agent amount per unit area of a developing agent layer, $m_{dev}$ is the amount of developing agent deposited per unit area on a latent image carrying member, in development, at the maximum image density, and p is the ratio of the circumferential speed of a developing agent carrying member to that of the latent image carrying member.

In the above relation, $m_{dev}/(m_1 \cdot p)$ represents a developing efficiency, as will be described below. That is, the present invention is based on the assumption that a proper image density can be maintained by maintaining a developing efficiency within a predetermined range, even if solid images are continuously developed.

A developing efficiency can be adjusted by properly controlling, e.g., a developing bias or a blade pressing force.

In the present invention, a proper image density can be maintained by adjusting the amount of developing agent deposited per unit area on a developing agent holding member to be 0.3 to 0.8 mg/cm$^2$, instead of adjusting a developing efficiency. In addition, the same effect can be obtained by adjusting the ratio of the circumferential speed of a developing agent carrying member and that of a latent image carrying member to be 1.2 to 3.0.

A preferred embodiment of the present invention will be described below with reference to the accompanying drawings.

Figure 1:
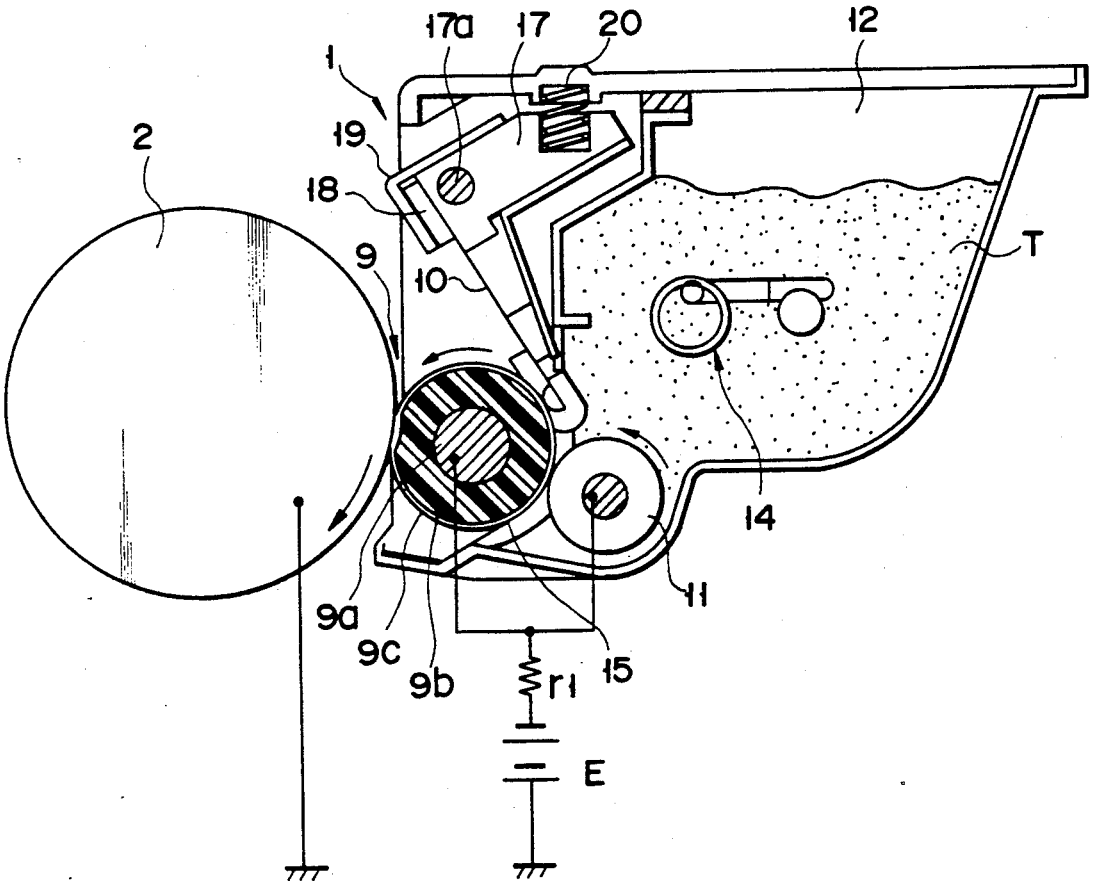
FIG. 1 is a sectional view of a developing unit used for the present invention.

A developing unit 1 shown in FIG. 1 is a contact type one-component developing unit which is arranged close to a photoreceptor drum 2 as a latent image carrying member on which a latent image to be developed is formed.

In this developing unit 1, a developing roller 9 as a developing agent carrying member is rotatably supported at a lower end corner of a toner container 12. The outer surface of the developing roller 9 is in contact with the photoreceptor drum 2. A blade 10 and a toner feed roller 11 are arranged in contact with the developing unit 9. The blade 10 serves as a developing agent regulating member. The toner feed roller 11 is arranged in the toner container 12.

The photoreceptor drum 2, the developing roller 9, and the toner feed roller 11 are respectively rotated in the directions indicated by arrows in FIG. 1. These members are in frictional contact with each other at the respective contact portions. Note that the toner feed roller 11 feeds a nonmagnetic toner T as a one-component developing agent, stored in the toner container 12, to the developing roller 9 and also serves to scrape a portion of the nonmagnetic toner T, which is not used for development and left on the developing roller 9, from the developing roller 9.

Figure 2:
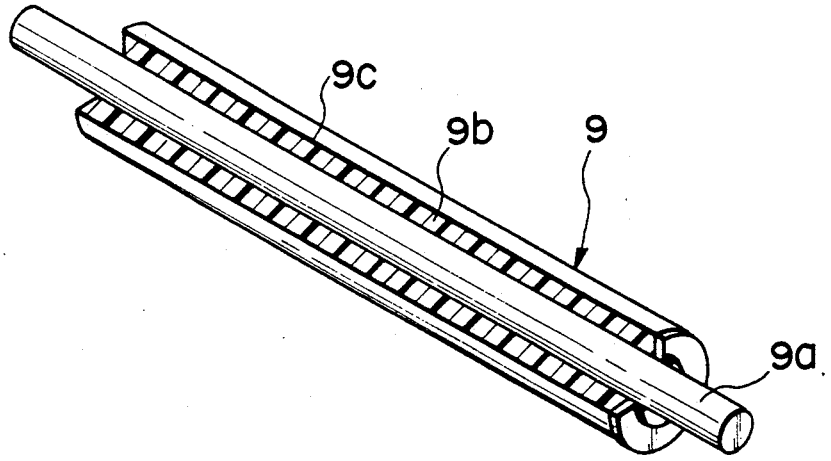
FIG. 2 is a cutaway perspective view of a developing roller of the developing unit in FIG. 1.

As shown in FIGS. 1 and 2, the developing roller 9 has a two-layered structure in which a resistive elastic layer **9*b* consisting of a rubber material is coated on the outer surface of a metal shaft 9*a* in the form of a cylinder, and a surface conductive layer 9*c* is coated on the outer surface of this resistive elastic layer 9*b***.

The rubber hardness of the resistive elastic layer **9*b* is preferably set to be 15 to 40 degrees. The rubber hardness of the structure consisting of the resistive elastic layer 9*b* and the surface conductive layer 9*c* is preferably set to be 20 to 50 degrees. In addition, the surface roughness of the surface conductive layer 9*c*** is preferably set to be 7 $\mu m_{RZ}$ or less in order to ensure the smoothness of the surface.

The blade 10 is constituted by an elastic thin plate, such as a stainless steel plate or a phosphor bronze plate, and is attached to a first blade holder 17 rotatably supported by a pivot **17*a*. The blade 10 is urged against the outer surface of the developing roller 9 by the elastic force of a press spring 20**.

Figure 3:
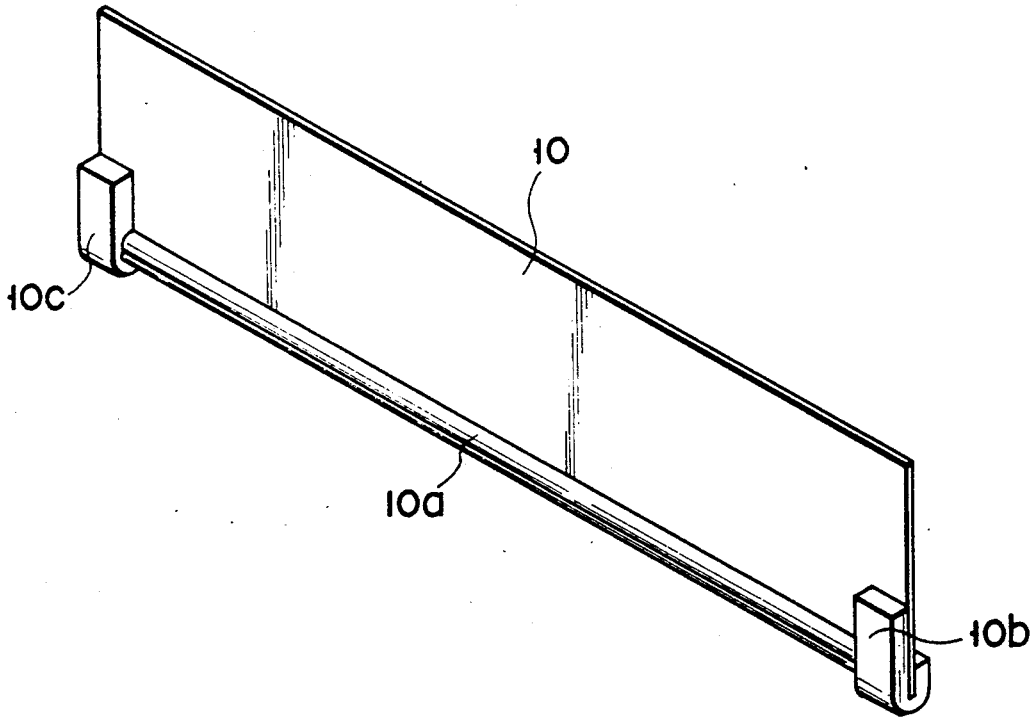
FIG. 3 is a perspective view of a blade of the developing unit in FIG. 1.

More specifically, the blade 10 is supported by the first blade holder 17, a spacer 18, and a second blade holder 19. As shown in FIG. 3, the blade 10 comprises an abutment portion **10*a* fixed to one edge of the blade 10, having a semicircular cross section, and consisting of a rubber material, such as a silicone rubber or an polyurethane rubber, or an elastic resin material, and end portion holders 10*b* and 10*c* respectively attached to two end portions of the abutment portion 10*a* and consisting of an polyurethane foam. The blade 10 is in contact with the developing roller 9** under pressure.

Since the spring constant of the press spring 20 is smaller than that of the blade 10, even if the abutment portion 10a of the blade 10 is abraded, the pressing force of the blade 10 is changed very little, thus maintaining its layer forming performance for a longer period of time. In this embodiment, the pressing force of the blade 10 against the developing roller 9 is set to be about 80 (g/cm).

Referring to FIG. 1, reference numeral 14 denotes an agitator arranged in the toner container 12; and 15, a recovery blade (consisting of a Mylar film) in slidable contact with the developing roller 9.

Charging of the photosensitive drum 2 and of the developing roller 9 will be described below.

In this embodiment, reverse development is performed by using the photoreceptor drum 2 which is negatively changed to have a surface potential of −550 V. The nonmagnetic toner T is negatively changed.

In addition, a developing bias power supply E applies a voltage of −220 V to the metal shaft 9a of the developing roller 9 through a protective resistor $r_1$ having a resistance of 100 kΩ to 50 kΩ.

Figure 4:
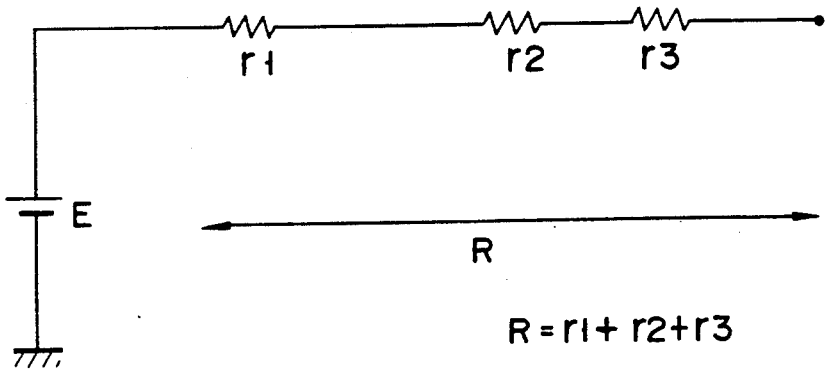
FIG. 4 is a circuit diagram showing a resistance between a developing bias power supply and a developing roller surface in the developing unit in FIG. 1.

A resistance between the surface of the developing roller 9 and the developing bias power supply E will be described below. A resistance R between the developing bias power supply E and the surface of the developing roller 9 is equal to a series resistance of a protective resistance $r_1$, a resistance $r_2$ of the resistive elastic layer 9b, and a resistance $r_3$ of the surface conductive layer 9c, as shown in FIG. 4.

That is, $R=r_1+r_2+r_3$

Figure 5:
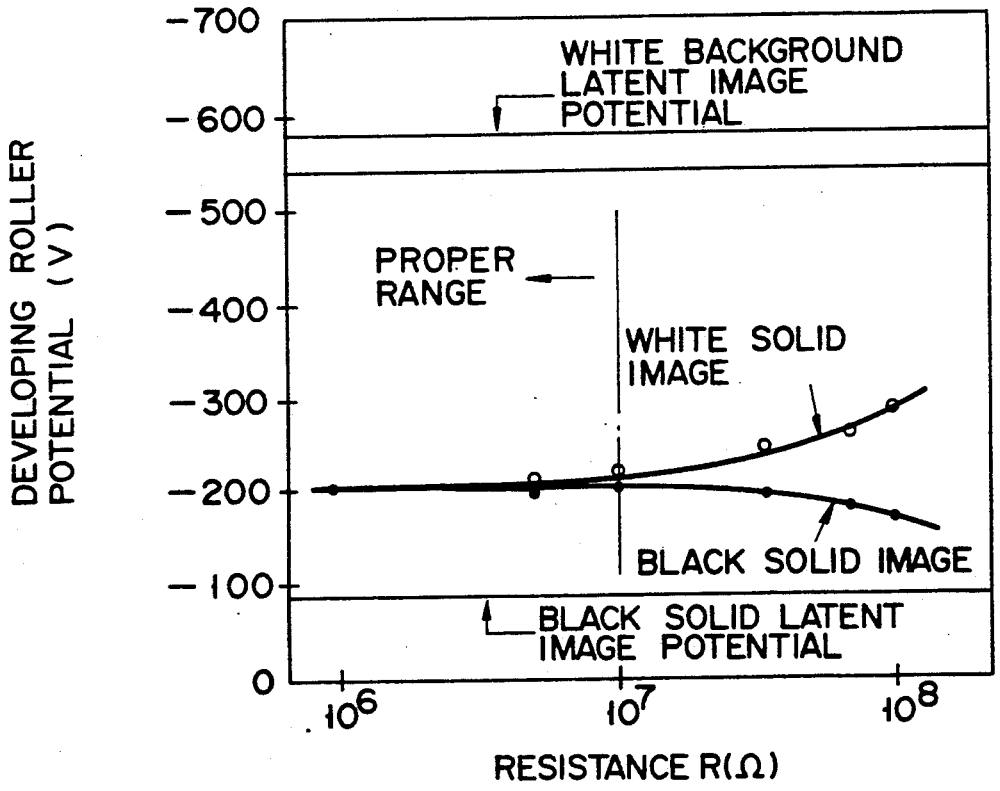
FIG. 5 is a graph showing a relationship between a resistance and the potential of the developing roller.

FIG. 5 shows a relationship between the surface potential of the developing roller 9, the resistance R, and the surface potential of the photoreceptor drum 2, while the resistance R is changed.

FIG. 5 shows how the surface potential of the developing roller 9 is changed with changes in the resistance R when the surface potential of the photoreceptor drum 2 is set to be −530 V (corresponding to a white background) and −70 V (corresponding to a black background). When the resistance R is $10^7$ Ω or more, the surface potential characteristic curves, of the developing roller 9, in white solid image printing and black solid image printing are gradually separated from each other. The surface potential of the developing roller 9 approaches a latent image potential with an increase in the resistance R. For this reason, in a printing operation of characters on a white background, since an increase in effective bias potential is caused by a white background latent image around each character, the width of each character is undesirably increased. Such tendency becomes more conspicuous with a resistance R of $10^8$Ω or more. Therefore, the resistance R is preferably set to be $10^8$Ω or less, more preferably $10^7$Ω or less. In this embodiment, $r_2+r_3=100\ k\Omega$, and $r_1=5\ M\Omega$ therefore, $R=5.1\times10^6\Omega$ In consideration of the above-described aspect, the resistive elastic layer 9b of the developing roller 9 of the present invention was constituted by a silicone rubber member having a rubber hardness of 25 degrees, an extension of about 425%, and a resistance of about $5\times10^3$ Ω.cm.

The surface conductive layer 9c was constituted by a conductive polyurethane coating (Sparex, available from Nihon Miractran K.K.) having a resistance of $5\times10^3$ Ω.cm and an extension of about 353%, and was formed as a surface layer having a thickness of about 70 μm. The developing roller 9 formed by using the above-described components had a rubber hardness of about 30 degrees, a resistance of about 100 kΩ between the shaft 9a and the surface, and a surface roughness of about 3 μm.

The photoreceptor drum 2 and the developing roller 9 are respectively driven by rotating/driving means (not shown) at, e.g., circumferential speeds of 70 mm/sec and 180 mm/sec, i.e., a circumferential speed ratio p of 18/7, in the directions indicated by the arrows in FIG. 1. The developing roller 9 is in contact with the photoreceptor drum 2 with a contact width (developing nip) of about 0.5 to 4 mm.

An operation of the developing unit 1 having the above-described arrangement will be described below.

The nonmagnetic toner T in the toner container 12 is supplied to the toner feed roller 11 while it is agitated by the agitator 14. The toner T is then fed to the developing roller 9 by the toner feed roller 11. The fed nonmagnetic toner T is charged upon friction with the developing roller 9 and is transferred to the blade 10 by an electrostatic force and a physical force.

The nonmagnetic toner T on the developing roller 9 is charged by frictional charging while the amount of passing toner is regulated by the blade 10. After the nonmagnetic toner T passes through blade 10, it is sufficiently charged, and is formed into a layer having a uniform thickness. The toner layer is then provided for the development of a latent image on the photoreceptor drum 2. The residual toner passes through the recovery blade 15 and returns to the toner container 12.

The developing method using the above-described developing unit 1 will be described in more detail below.

The developing unit 1 of this embodiment was incorporated in a laser printer TN-7300 available from TOSHIBA COPR, and tests were conducted. A process speed was 72 mm/sec, a negative charge type OPC drum was used for the photoreceptor drum 2 (diameter 60 mm), and the circumferential speed of the developing roller 9 was 144 mm/sec., i.e., the ratio of the circumferential speed of the developing roller 9 to that of the photoreceptor drum 2 was 2.

As the nonmagnetic toner T, a negative toner was used, which was obtained by dispersing carbon, wax, and a charge control agent in a styrene acrylic resin. Note that if the carbon content of the nonmagnetic toner T is large, toner filming tends to occur on the developing roller 9. For this reason, the carbon content of the nonmagnetic toner T was set to be 2.5%, which is smaller than that of a general toner.

In a conventional developing method in which the nonmagnetic toner T is transferred to the photoreceptor drum 2 by using the developing roller 9 having no magnetic pole therein, without using magnetism, the nonmagnetic toner T cannot be satisfactorily transferred in solid imaging printing, resulting in a decrease in density of a trailing end portion of a solid image. For this reason, in the present invention, a solid image transferring rate is defined as follows, in consideration of a toner transferring rate in solid image printing:

solid image transferring rate $R_b=D_e/D_s\times100$ (1)

where $D_s$ is the density of a solid image leading end, and $D_e$ is the density of a solid image trailing end.

A nonmagnetic toner transferring rate was measured while the silica content, of the toner, associated with its fluidity is changed, on the assumption that there was a strong correlation between the transferring rate and the fluidity of the toner. A measurement method will be described below.

Figure 6:
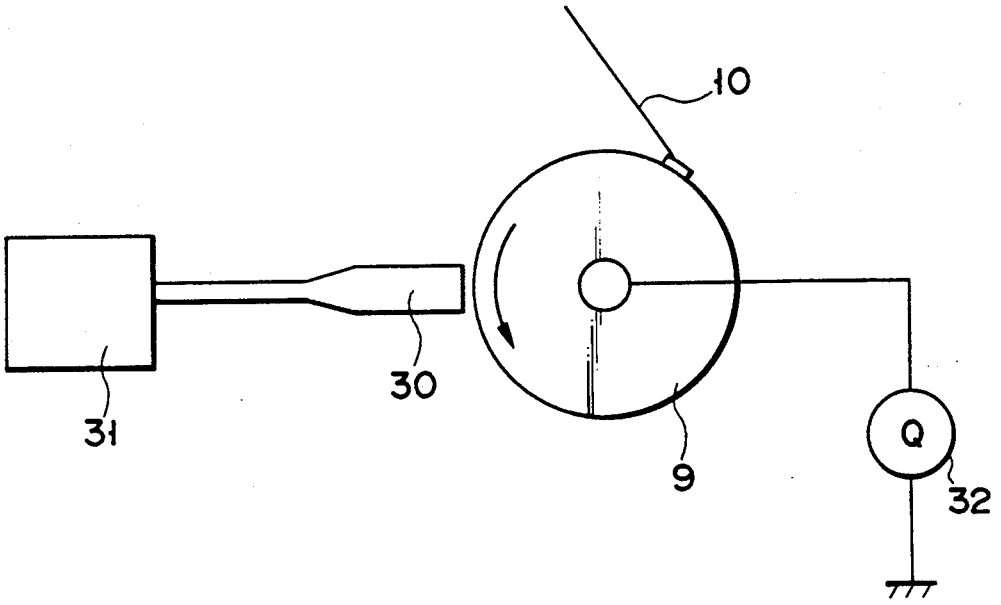
FIG. 6 is a schematic view showing a suction unit for a nonmagnetic toner.
Figure 7:
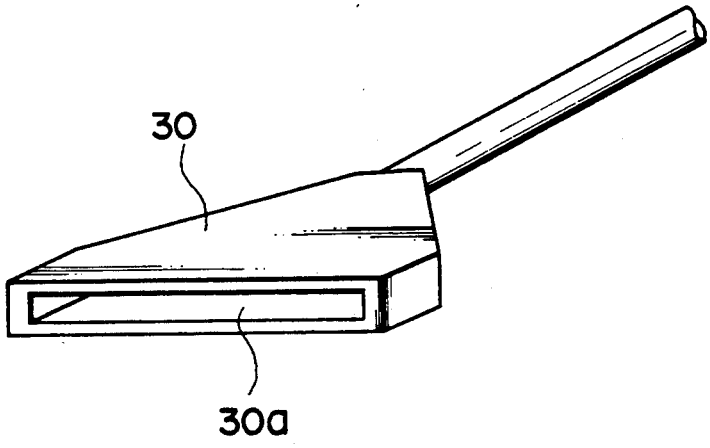
FIG. 7 is an enlarged perspective view of a suction attachment of the unit in FIG. 6.

FIGS. 6 and 7 schematically show a measuring unit. A suction attachment 30 (an opening 30*a* having an area of 20 $cm^2$) was arranged to oppose the developing roller 9 on which a toner layer was formed. The toner layer was drawn by a suction unit 31. A weight change $W_{d1}$ before and after suction, and escape charge $Q_{t1}$ measured (by a micro-ammeter 32) upon peeling of the nonmagnetic toner T from the developing roller 9 were obtained. A nonmagnetic toner layer amount ($m_1$) per unit area and a charge quantity in a normal state were calculated as follows:

$$m_1 = W_{d1}/20(g/cm^2) \quad (2)$$

$$Q_1 = Q_{t1}/Wd(\mu c/g) \quad (3)$$

In order to estimate the rising characteristic of charging and a toner transferring rate, a charge quantity and a toner amount per unit area upon continuous suction operation with respect to the entire surface of the developing roller 9 were measured. The measurement was performed while the developing roller 9 was rotated by the unit shown in FIG. 6 and suction operations corresponding to 20 revolutions of the roller 9 were continuously performed. A drawn toner amount $W_{d2}$ and an escape charge quantity $Q_{t2}$ in this case were obtained. A toner amount $m_2$ per unit area and a toner charge quantity $Q_2$ in the continuous suction operations were obtained from these values according to equations (4) and (5):

$$m_2 = W_{d1}/(S \times 20)(g/cm^2) \quad (4)$$

$$Q_2 = Q_{t2}/W_d(c/g) \quad (5)$$

In addition, a rising characteristic $R_q$ and a toner transferring rate $R_m$ were defined as follows:

$$R_m = m_2/m_1 \times 100(\%) \quad (6)$$

$$R_q = Q_2/Q_1 \times 100(\%) \quad (7)$$

A method of measuring the fluidity of a toner will be described below. As a measuring unit, a powder tester (available from Hosokawa micron K.K.) is used. The fluidity of a toner is measured in accordance with the following procedure:

(1) A nonmagnetic toner is put into a polyvinyl bottle and is shaken by hand 20 times.

(2) 200-, 100-, and 60-mesh screens of the power tester are stacked upwardly in the order named.

(3) 20 g of the nonmagnetic toner are measured and gently put in the 60-mesh screen.

(4) A vibration mode is set to vibrate the 60-mesh screen for 30 seconds.

(5) The total amount of residual toner on the 60- and 100-mesh screens is regarded as the fluidity of the toner (the smaller the value, the higher the fluidity).

Figure 8:
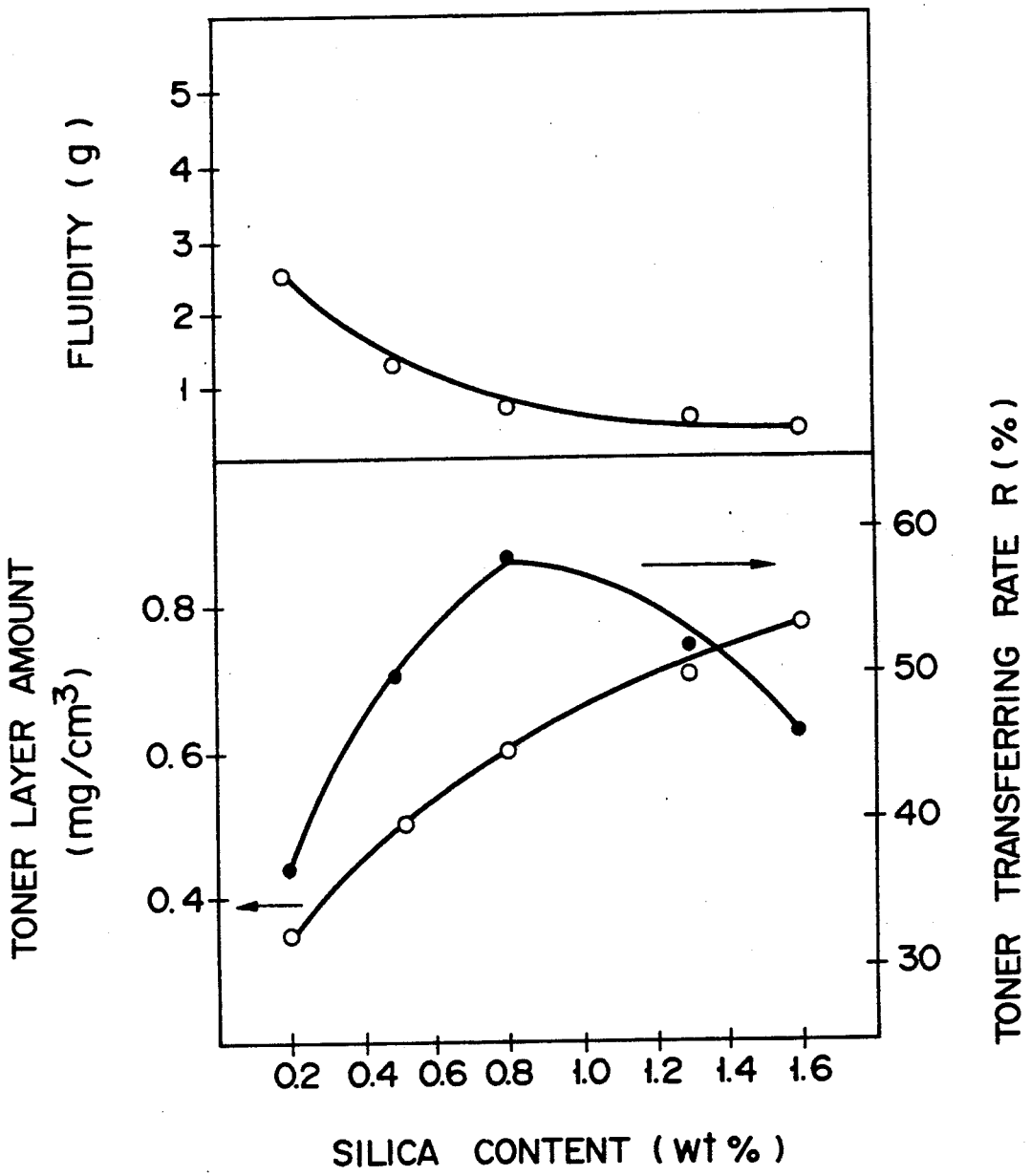
FIG. 8 is a graph showing a relationship between a silica content of a toner, the fluidity of the toner, a toner layer amount, and a toner transferring rate.

By using the above-described measurement method, the fluidity of a toner (g), a weight $m_1$ per unit area ($mg/cm^2$) of a toner layer formed on the developing roller 9, and a toner transferring rate $R_m$ (%) were obtained while the silica content of the toner was changed. FIG. 8 shows the result.

As is apparent from the graph in FIG. 8, with an increase in silica content, the fluidity of the toner is improved (the degree of fluidity is decreased) to increase the toner layer amount. The toner transferring rate was increased with an improvement in the fluidity of the toner. However, when the toner layer amount exceeded 0.6 ($mg/cm^2$), charging of the toner became insufficient, and the transferring performance reached its limit (the value of m was saturated at about 0.35 ($mg/cm^2$) regardless of the fluidity). For this reason, the toner transferring rate was decreased with an improvement in fluidity. The optimal transferring rate was obtained with a silica content of 0.8% under the conditions used in this case.

This optimal value, however, varies depending on, e.g., a material used for the nonmagnetic toner T, the structure of the developing unit 1, and the type of additive agent (titanium oxide, alumina, or the like). Even if the silica content is optimized in this manner, a toner transferring rate of only 60% can be obtained. This result indicates that if a toner layer on the developing roller 9 is developed at 100%, a solid image transferring error may be caused.

Figure 9:
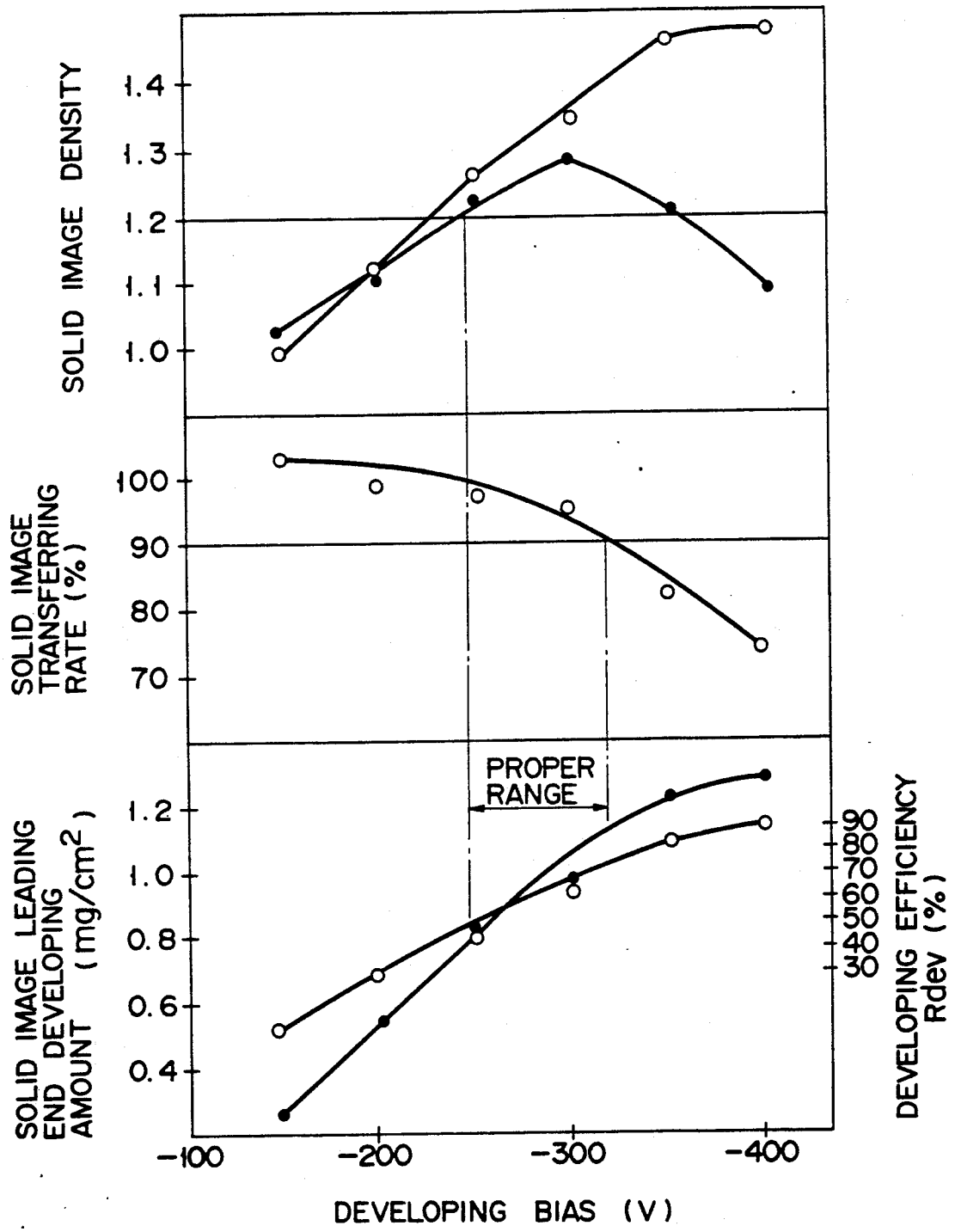
FIG. 9 is a graph showing a relationship between a developing bias, a solid image density, a solid image transferring rate, a solid image leading end developing amount, and a developing efficiency.

Under the circumstances, a solid image printing test was conducted by using an actual apparatus using a toner having a silica content of 0.8% with which the optimal toner fluidity was obtained. The surface potential of a photoreceptor member and the potential of an exposed portion were respectively fixed to −530 V and −70 V, and a developing bias potential was changed from −150 to −400 V. FIG. 9 shows a relationship between a developing bias, a solid image density, a solid image transferring rate, a developing toner amount, and a developing efficiency in this case. The developing toner amount was measured by interrupting an actual solid image printing operation and drawing the toner amount $m_{dev}$, used for developing a solid image leading end portion, by the unit shown in FIG. 6. A developing efficiency $R_{dev}$ is defined by the following equation:

$$R_{dev} = m_{dev}/(m_1 \times p) \quad (8)$$

where p is the ratio of the circumferential speed of the developing roller to that of the photosensitive member.

As the developing bias is decreased (the absolute value is increased), the developing efficiency $R_{dev}$ is increased, and a solid image leading end density $D_s$ is gradually increased. At a developing bias of (−)250 V or lower, an image density of 1.2 or more is obtained. At a developing bias of (−)350 V or lower, saturation occurs at a density of about 1.45. In contrast to this, a solid image trailing end density De tends to decrease at a developing bias of (−)300 V or lower. With an increase in bias voltage, the solid image transferring rate is decreased in this manner. Note that if the solid image transferring rate becomes 90% or less, a change in density can be easily recognized even by the naked eye. For this reason, a solid image transferring rate of 90% or more is required. Therefore, it is required that the developing efficiency Rdev be 85 to 90% or less, and the solid image density be 1.2 or more. In this embodiment, the proper range of a developing bias was from about −250 V to −320 V. Although a high solid image transferring rate can be obtained with a developing efficiency $R_{dev}$ of 85 to 90% or less, a developing efficiency of 80% or less is preferable. As the developing efficiency $R_{dev}$ is decreased, a higher solid image transferring rate can be obtained. However, with a decrease in the developing efficiency $R_{dev}$, density variations become conspicuous because the thickness of a toner layer is not perfectly uniform. Furthermore, in continuous printing, if a large amount of residual toner is left (i.e., the developing efficiency $R_{dev}$ is low), charge up of the nonmagnetic toner T and adhesion of the toner to the developing roller 9 tend to occur. Such a phenomenon occurs when the developing efficiency $R_{dev}$ is 40% or less.

For the above-described reasons, the proper range of the developing efficiency $R_{dev}$ is from 40% to 90%, preferably 40 to 80%.

In this embodiment, the developing efficiency $R_{dev}$ is adjusted by optimizing a developing bias. However, a similar effect can be obtained by adjusting the ratio of the circumferential speed of the developing roller 9 to that of the photoreceptor drum 2, a developing pressure, the charge quantity of a toner, the pressing force of the blade 10, the resistance of the protective resistor $r_1$, the resistance of the developing roller, or the like.

Figure 10:
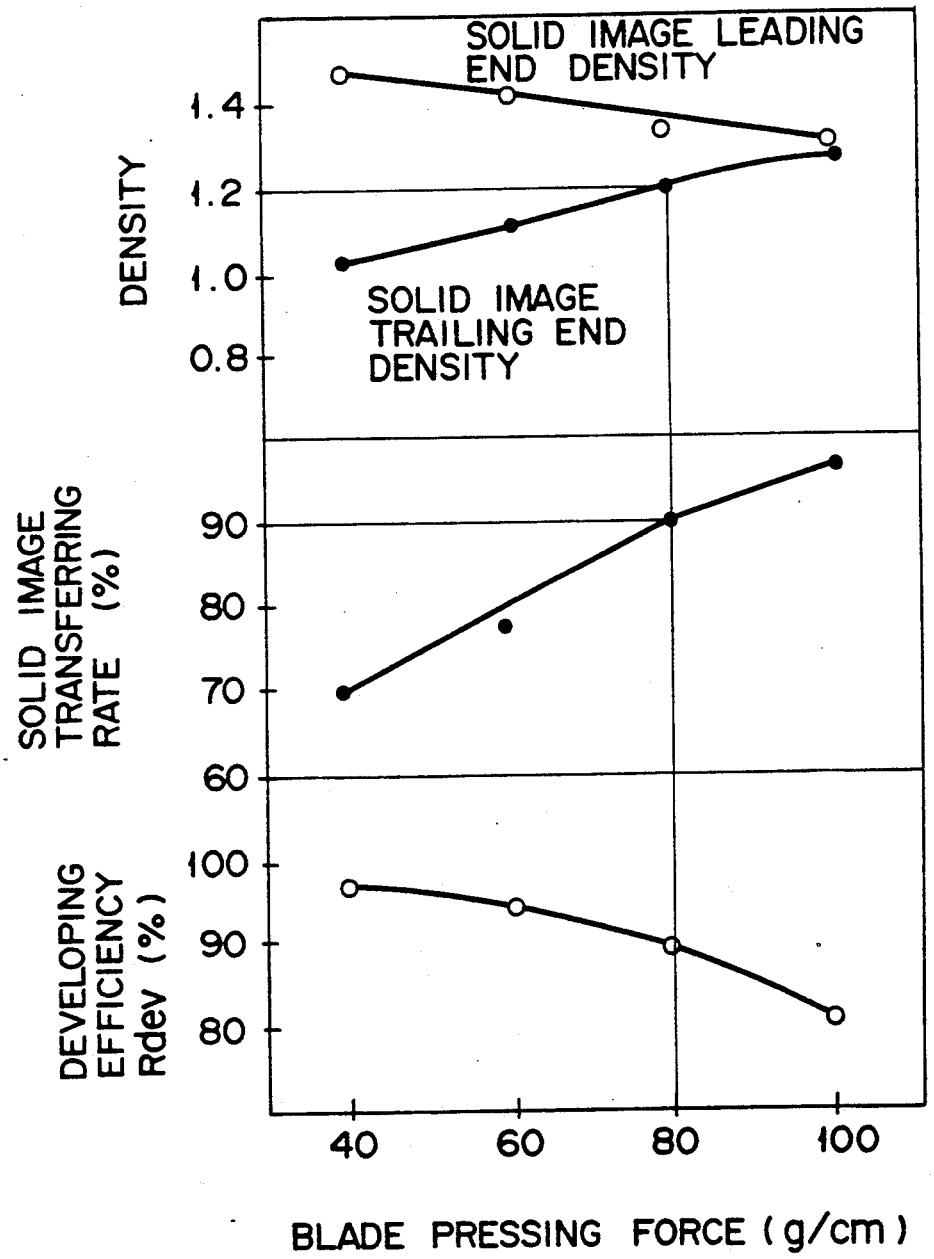
FIG. 10 is a graph showing a relationship between a blade pressing force, an image density, a solid image transferring rate, and a developing efficiency.

FIG. 10 shows the result obtained when the developing efficiency $R_{dev}$ is adjusted by adjusting a blade pressing force. As the nonmagnetic toner T, a toner having a silica content of 0.8% was used, and a solid image printing operation was performed at a developing bias of −280 V. As shown in FIG. 10, it was found that a blade pressing force (linear pressure) of 80 (g/cm) or more was a condition for satisfying the requirements, i.e., a density of 1.2 or more and a solid image transferring rate of 90% or more. In addition, it was confirmed that a proper transferring rate was obtained when the developing efficiency $R_{dev}$ was 90% or less. When the blade pressing force was 200 (g/cm) or more, although the result obtained at a blade pressing force of 100 (g/cm) or more is not shown in FIG. 10, the image density was decreased to a value below 1.2 Therefore, the proper range of a blade pressing force is about from 80 to 200 (g/cm).

The present inventors found that image density and image quality are closely related to the degree of fluidity of a toner, the amount of a toner deposited on a developing roller, a roller circumferential speed ratio, the charge quantity of toner, a toner particle size, and an intermediate roller potential bias. Therefore, the present inventors conducted tests on the optimal values of these factors.

Figure 11:
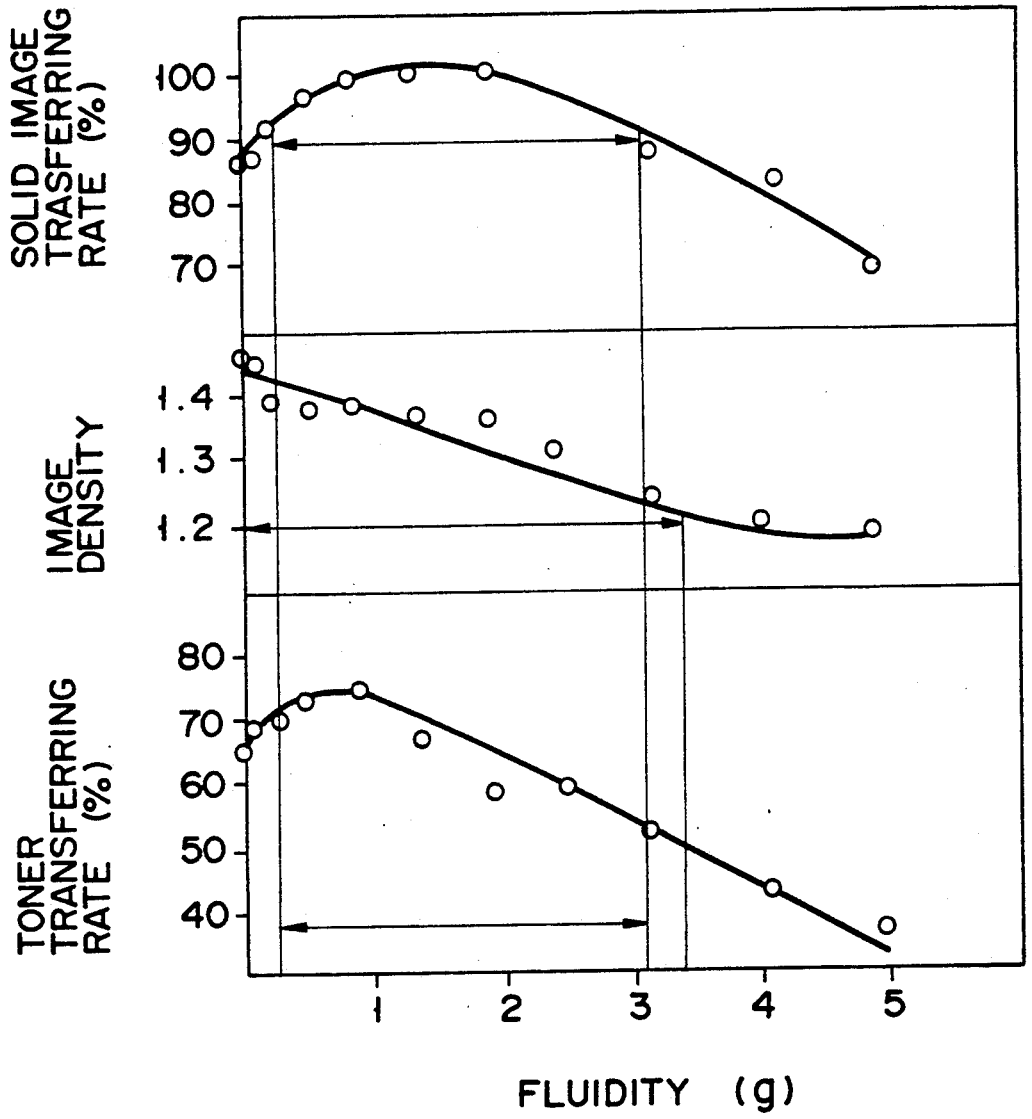
FIG. 11 is a graph showing a relationship between the fluidity of a toner, a solid image transferring rate, an image density, and a toner transferring rate.

FIG. 11 is a graph showing a relationship between the degree of fluidity of a toner, a solid image transferring rate, an image density, and a toner transferring rate. Measurement conditions were: a blade pressure, 80 g/cm; a roller circumferential speed ratio, 2:1; and a developing efficiency, about 75%. Note that the fluidity of a toner was adjusted by adjusting a silica content, and a developing efficiency was adjusted by a developing bias.

It is apparent from the graph in FIG. 11 that a good result can be obtained when the fluidity of the toner is 0.2 to 3.0 g. The smaller the fluidity of a toner, the better the fluidity of the toner. If the fluidity of a toner is poor, a reduction in toner transferring rate occurs, resulting in deterioration in the solid image following performance. In addition, the thickness of a toner layer is reduced, leading to an insufficient image density. In contrast to this, if the fluidity of a toner is excessively high, the thickness of a toner layer is increased, and the charge quantity is decreased, resulting in a deterioration in solid image following performance.

Figure 12:
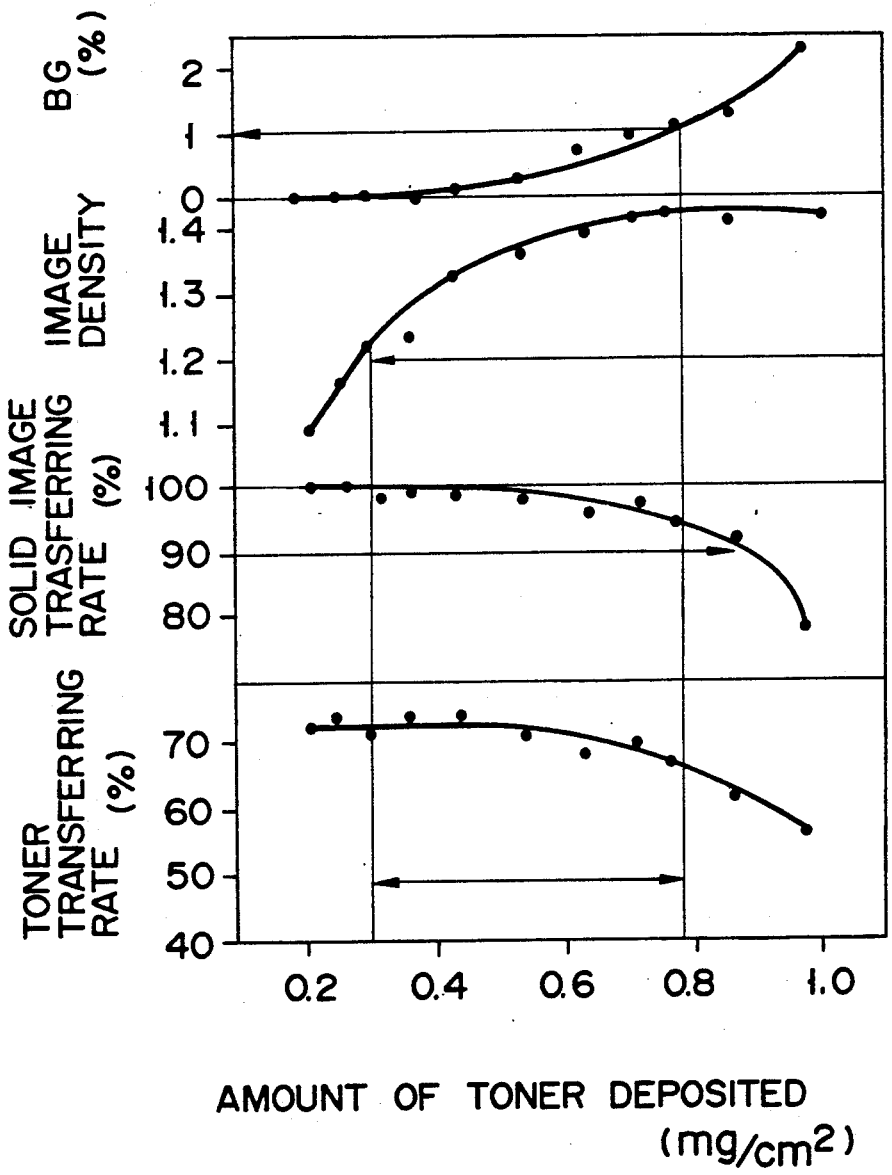
FIG. 12 is a graph showing a relationship between the amount of toner deposited on the developing roller, BG, an image density, a solid image transferring rate, and a toner transferring rate.

FIG. 12 is a graph showing a relationship between the amount of a toner deposited on the developing roller, BG, an image density, a solid image transferring rate, and a toner transferring rate. Measurement conditions were: a roller circumferential speed ratio, 2:1; the fluidity of a toner, 0.9 g; and a developing efficiency, about 75%. Note that the deposited toner amount was adjusted by changing the blade pressure and blade shape.

It is apparent from the graph in FIG. 12 that a good result can be obtained when the deposited toner amount if 0.3 to 0.8 mg/cm$^2$. If the deposited toner amount is too small, the image density becomes insufficient. If the deposited toner amount is too large, fog increases. In addition, the toner transferring rate is decreased, and solid image following performance is degraded.

Figure 13:
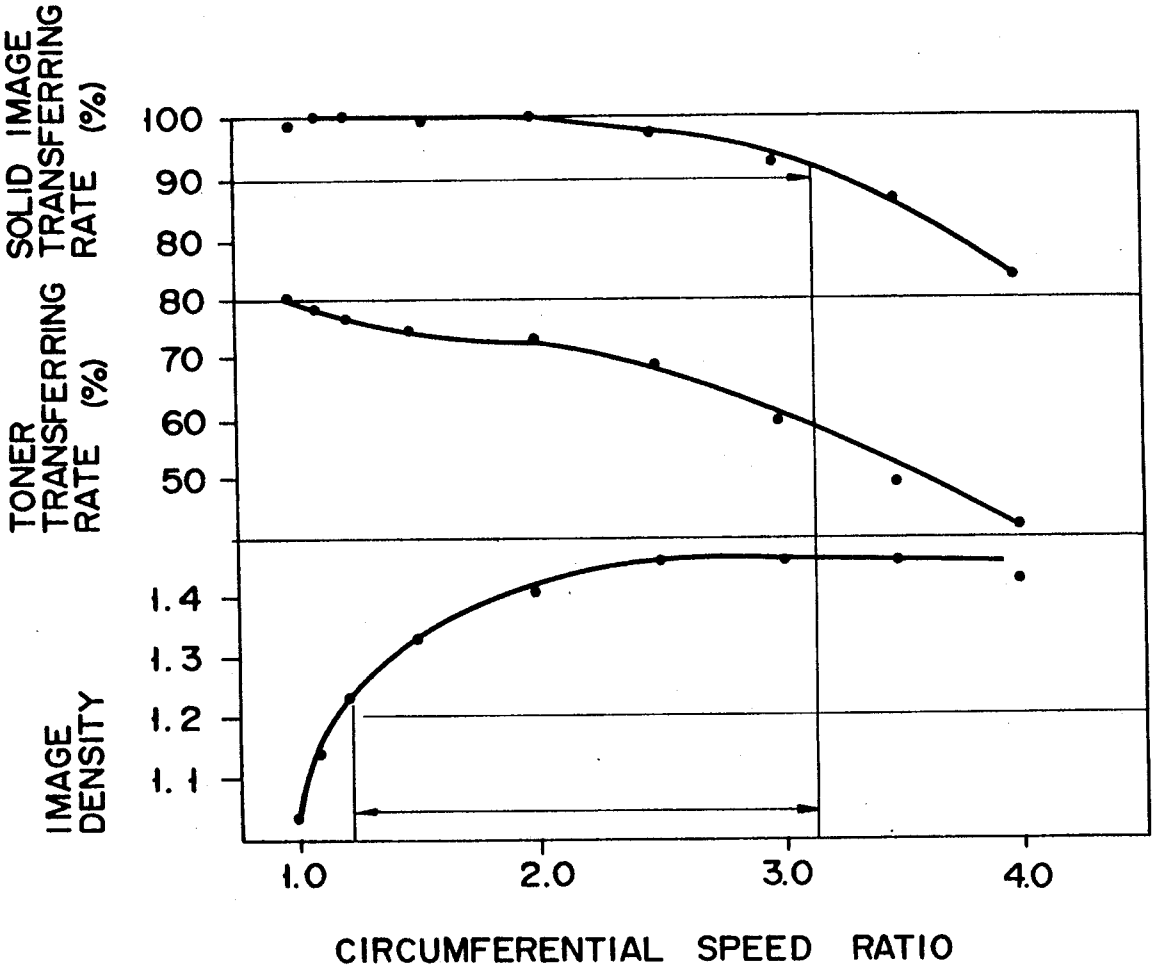
FIG. 13 is a graph showing a relationship between a circumferential speed ratio, a solid image transferring rate, a toner transferring rate, and an image density.

FIG. 13 is a graph showing a relationship between a roller circumferential speed ratio, a solid image transferring rate, a toner transferring rate, and an image density. Measurement conditions were: a blade pressure, 80 g/cm; a toner deposited amount, 0.61 g/cm$^2$. $V_o$, −600 V; $V_b$, −200 V; and the fluidity of a toner, 0.9 g.

It is apparent from the graph in FIG. 13 that a good result can be obtained when the roller circumferential speed ratio is 1.2 to 3.0. If the roller circumferential speed ratio is too low, the image density becomes insufficient. If the ratio is too high, the toner transferring rate is decreased, resulting in a deterioration in solid image following characteristic. In addition, jitter is undesirably increased.

Figure 14:
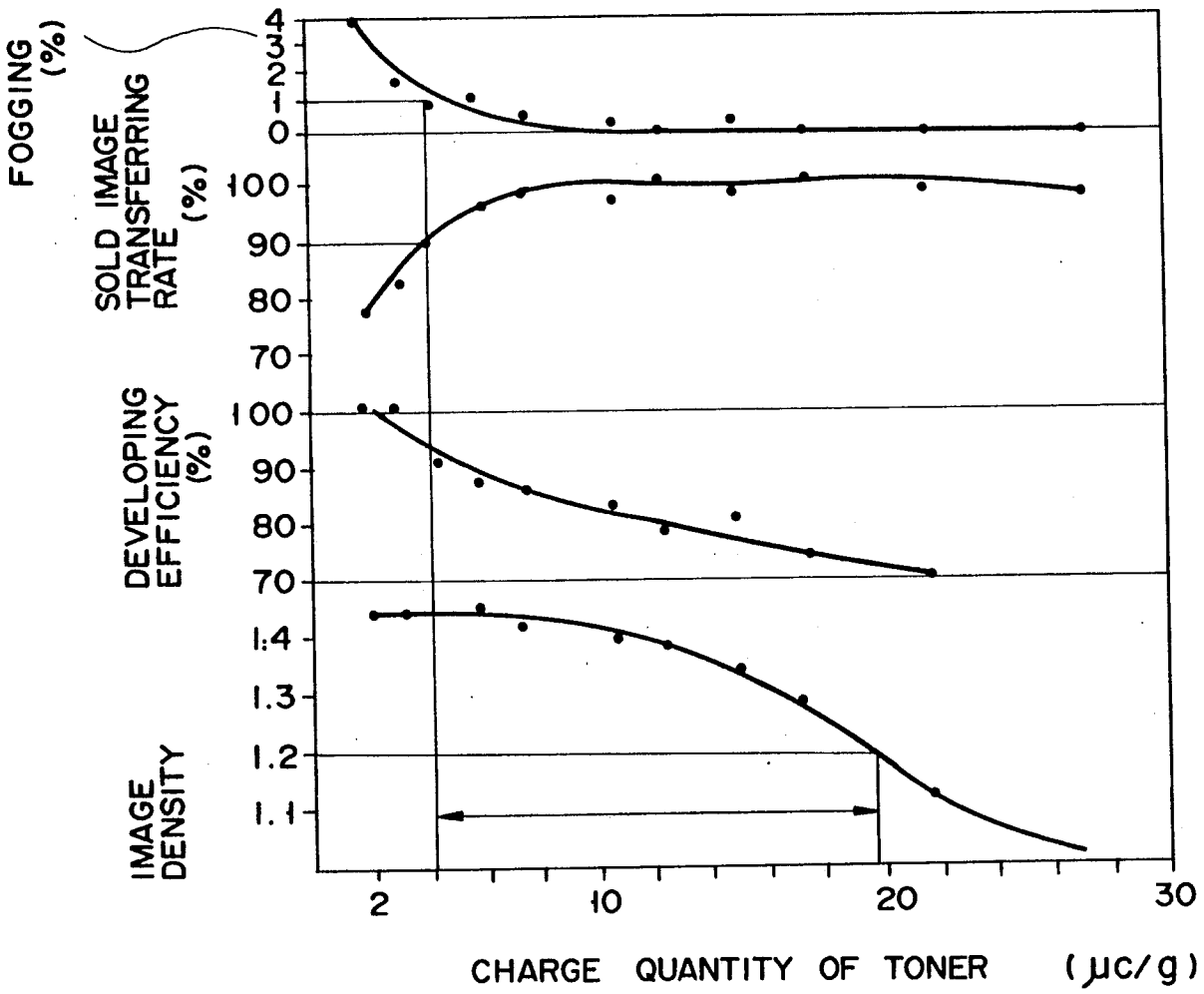
FIG. 14 is a graph showing a relationship between the charge quantity of toner, fogging, a solid image transferring rate, a developing efficiency, and an image density.

FIG. 14 is a graph showing a relationship between the charge quantity of toner, fogging, a solid image transferring rate, a developing efficiency, and an image density. Measurement conditions were: a toner deposited amount, 0.51 to 0.6 g/cm$^2$, $V_o$, −600 V; $V_b$, −200 V; an intermediate roller potential, −200 V, and a roller circumferential speed ratio, 2:1. Note that the charge quantity of toner was adjusted by selectively adding a charge control agent to the toner, or controlling a blade pressure.

It is apparent from the graph in FIG. 14 that a good result can be obtained when the charge quantity of toner is 4 to 20 μc/g. If the charge quantity of toner is too small, fogging is caused, and the developing efficiency is increased, resulting in a reduction in solid image transferring rate. If the charge quantity is too large, the image density becomes insufficient.

Figure 15:
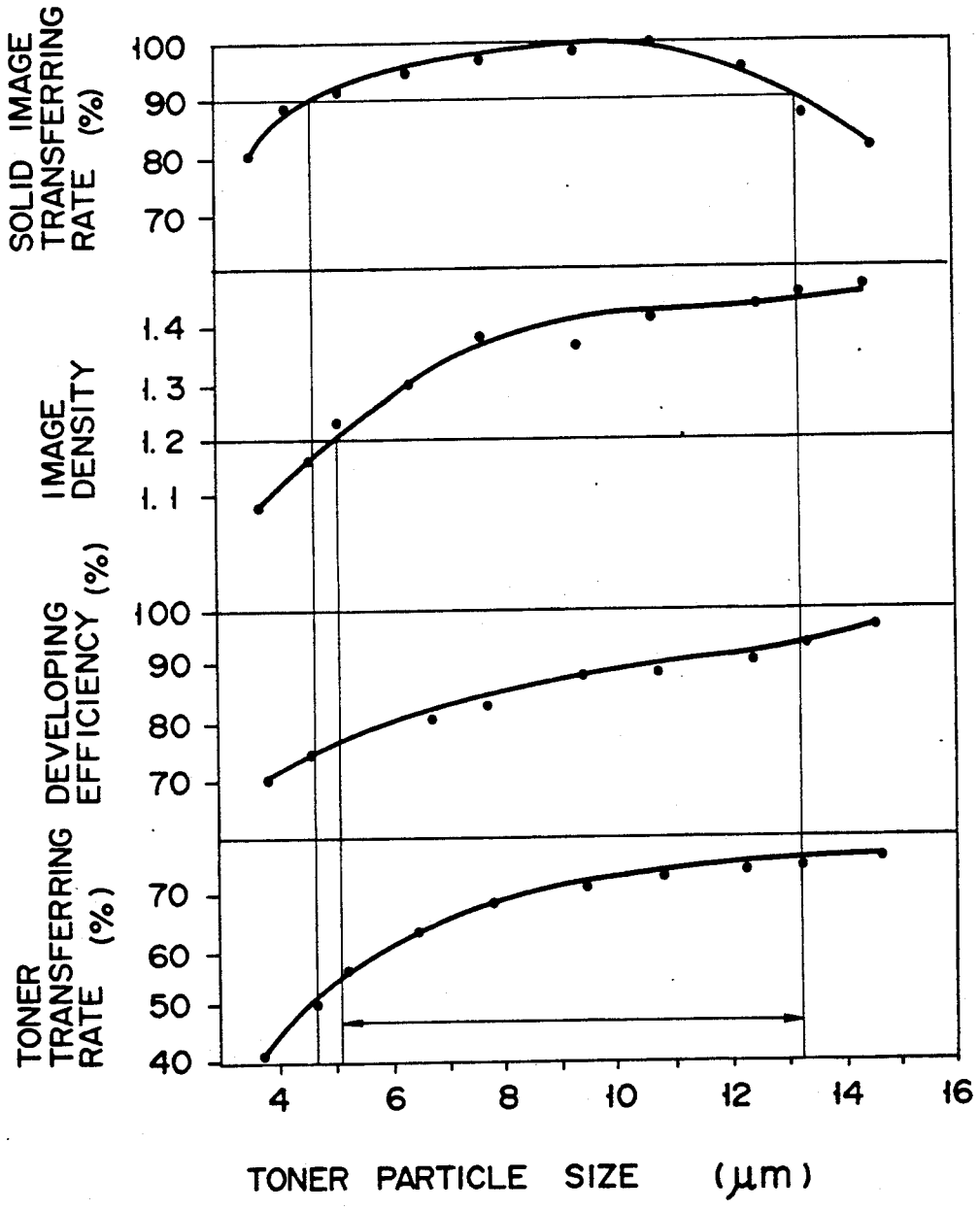
FIG. 15 is a graph showing a relationship between a toner particle size, a solid image transferring rate, an image density, a developing efficiency, and a toner transferring rate.

FIG. 15 is a graph showing a relationship between a toner particle size, a solid image transferring rate, a developing efficiency, and a toner transferring rate. Measurement conditions were: the thickness of a toner layer, 0.5 to 0.64 g/cm$^2$; $V_o$, −600 V; $V_b$, −200 V, an intermediate roller potential, −200 V; and a roller circumferential speed ratio, 2:1.

It is apparent from the graph in FIG. 15 that a good result can be obtained when the toner particle size is 5 to 13 μm. If the toner particle size is too small, the developing efficiency is decreased, and the image density becomes insufficient, although good image quality can be obtained. In addition, since the toner transferring rate is decreased, a deterioration in solid image following performance occurs. In contrast to this, if the toner particle size is too large, the developing efficiency is increased, and a decrease in image density occurs. In addition, a deterioration in image quality is caused.

Figure 16:
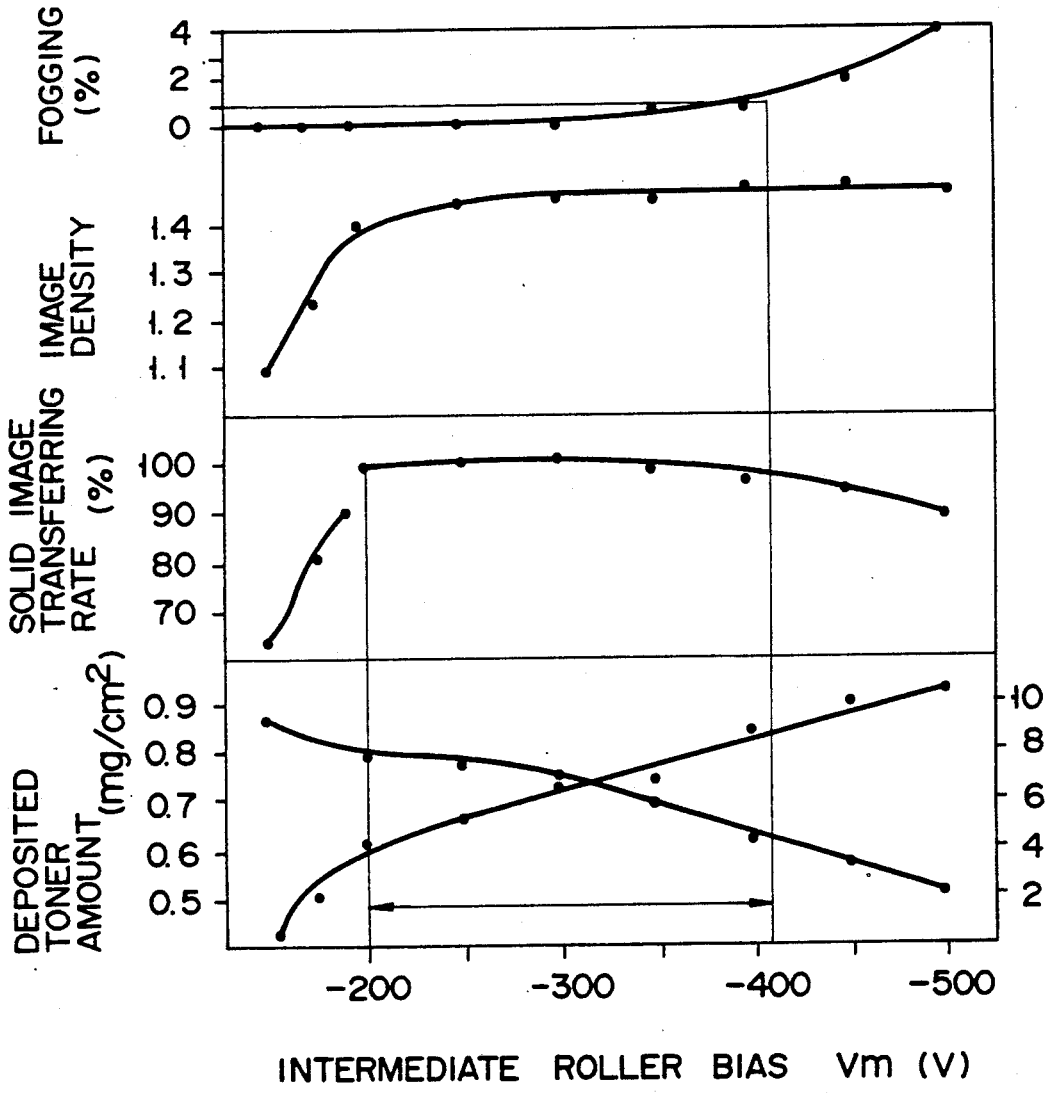
FIG. 16 is a graph showing a relationship between an intermediate roller potential difference (an electric field for feeding a toner to the developing roller), BG, an image density, a solid image transferring rate, the charge quantity of toner on the roller, and a deposited toner amount.

FIG. 16 is a graph showing a relationship between an intermediate roller potential difference (an electric field for feeding a toner to a developing roller), BG, an image density, a solid image transferring rate, the charge quantity of a toner on the roller, and a deposited toner amount. Measurement conditions were: $V_o$, −600 V; $V_b$, −200 V; a blade pressure, 90 g/cm$^2$; and a roller circumferential speed ratio, 2:1.

It is apparent from the graph in FIG. 16 that a good result can be obtained when the intermediate roller bias is −200 to −400 V, i.e., an intermediate roller potential difference of 0 to 200 V. Since a toner feed bias is applied, when an intermediate roller bias $V_m$ exceeds −400 V, even if the toner deposited amount exceeds 0.8 mg/cm$^2$, a solid image transferring rate of 90% or more is obtained. However, fogging tends to be increased.

In addition to the above-described embodiment, various modifications of the present invention can be made.

The present invention can be applied to developing methods using developing rollers having no magnets arranged therein, such as a noncontact developing method and a contact developing method using a developing roller having no elasticity. Furthermore, the present invention can be applied to even a developing method using a toner containing a magnetic powder unless the toner is transferred by using magnets.

The present invention may use a known developing mode (normal and reverse), known material and structures for a developing roller and a blade, a known type of toner, and the like.

As has been described above, according to the developing method of the present invention, a proper developing efficiency can be set, and images having proper image densities can be continuously developed.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An image forming apparatus comprising:

roller means, opposing a rotatable image carrying member, for supplying a one-component developing agent to the rotatable image carrying member;

means for forming a developing agent layer of the one-component developing agent to be supplied to the image carrying member on the roller means; and means for developing a latent image on the rotatable image carrying member by the one-component developing agent supplied by the supplying means under conditions satisfying the following relation:

$$0.4 \leqq m_{dev}/(m_1 \cdot p) \leqq 0.8$$

where $m_1$ is an amount of the one-component developing agent per unit area of the developing agent layer, $m_{dev}$ is an amount of the one-component developing agent deposited per unit area on the image carrying member, at the maximum image density, and p is a ratio of a circumferential speed of said roller means to that of the rotatable image carrying member.

2. An apparatus according to claim 1, wherein the developing agent has a fluidity of 0.2 to 3.0 g.

3. An apparatus according to claim 1, wherein the developing agent on the roller means has a charge quantity of 4 to 20 μc/g.

4. An apparatus according to claim 1, wherein the developing agent has a particle size of 5 to 13 μm.

5. An apparatus according to claim 1, wherein the amount of the developing agent deposited per unit area on said roller means is 0.3 to 0.8 mg/cm$^2$.

6. An apparatus according to claim 1, wherein a ratio of a circumferential speed of the roller means to that of the image carrying member is 1.2 to 3.0.

7. An apparatus according to claim 1, wherein a voltage to be applied to the roller means is controlled in a range of 250 to 320 V.

* * * * *